US005405032A

United States Patent [19]

Anderson

[11] Patent Number: 5,405,032

[45] Date of Patent: Apr. 11, 1995

[54] TAMPER INDICATING CLOSURE AND METHOD AND DEVICE FOR THE MANUFACTURE OF A TAMPER-INDICATING CLOSURE

[75] Inventor: Jimmy L. Anderson, Chesterfield, Va.

[73] Assignee: Crown Cork & Seal Company, Inc., Philadelphia, Pa.

[21] Appl. No.: 9,665

[22] Filed: Jan. 27, 1993

Related U.S. Application Data

[63] Continuation of Ser. No. 973,035, Nov. 6, 1992, abandoned.

[51] Int. Cl.[6] ..... B65D 41/34

[52] U.S. Cl. ..... 215/252

[58] Field of Search ..... 215/252, 258

[56] References Cited

U.S. PATENT DOCUMENTS

| | | | |
|---|---|---|---|
| 3,673,761 | 7/1972 | Leitz | 53/42 |
| 4,332,009 | 3/1982 | Mumford | 215/253 |
| 4,432,461 | 2/1984 | Mumford et al. | 215/252 |
| 4,503,985 | 3/1985 | Swartzbaugh et al. | 215/252 |
| 4,535,904 | 8/1985 | O'Connor et al. | 215/215 |
| 4,664,279 | 5/1987 | Obrist et al. | 215/252 |
| 4,895,265 | 1/1990 | Luch et al. | 215/31 |
| 4,923,073 | 5/1990 | Wilde | 215/252 |
| 5,074,425 | 12/1991 | Wüstmann et al. | 215/252 |
| 5,080,246 | 1/1992 | Hayes | 215/252 |
| 5,107,998 | 4/1992 | Zumbuhl | 215/252 |

FOREIGN PATENT DOCUMENTS

| | | | |
|---|---|---|---|
| 3723235 | 1/1989 | Germany | 215/252 |

*Primary Examiner*—Allan N. Shoap
*Assistant Examiner*—Vanessa Caretto
*Attorney, Agent, or Firm*—Woodcock, Washburn, Kurtz, Mackiewicz & Norris

[57] ABSTRACT

A plastic tamper-indicating closure comprises a cap and a tamper-indicating band attached thereto by primary and secondary connecting bridges having different strengths, so that the secondary bridges are broken substantially more easily than are the primary bridges when the cap is removed from the neck of a container.

2 Claims, 4 Drawing Sheets

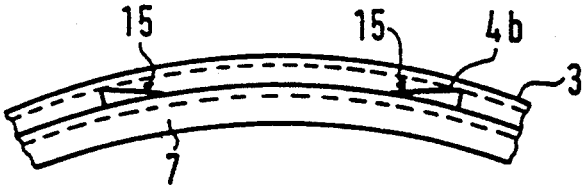
Fig. 6a
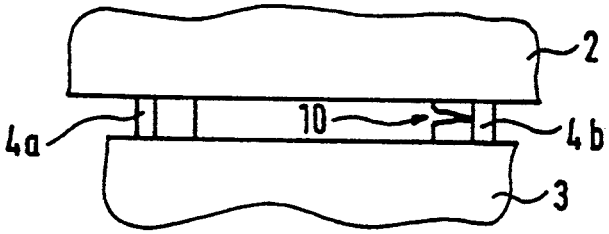
Fig. 6b
Fig. 7a
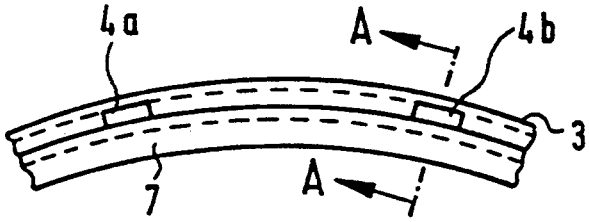
Fig. 7c
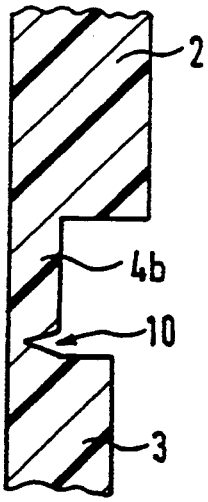
Fig. 7b
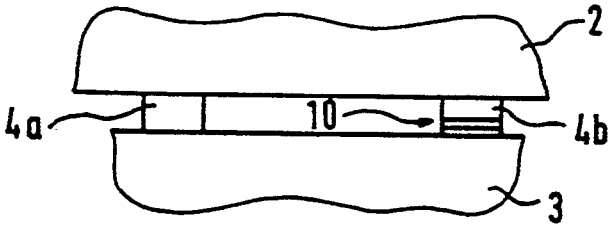
Fig. 8
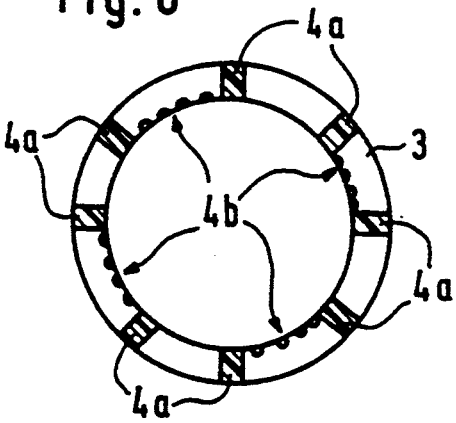
Fig. 9
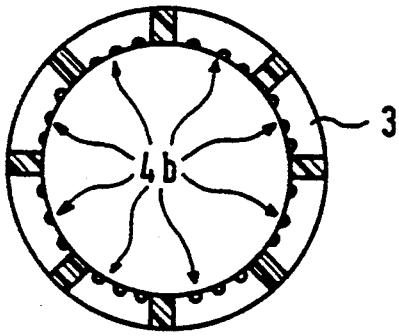

TAMPER INDICATING CLOSURE AND METHOD AND DEVICE FOR THE MANUFACTURE OF A TAMPER-INDICATING CLOSURE

This is a continuation of application Ser. No. 07/973,035, filed Nov. 6, 1992, now abandoned.

BACKGROUND OF THE INVENTION

The invention relates to a tamper-indicating closure, as well as to a method and device for the manufacture of a tamper-indicating closure.

Tamper-indicating closures for the closure of containers are widely known and in use. As a rule, this type of closure is provided with a tamper-indicating band which is connected to the closure, by numerous connecting bridges that can be broken by removal of the cap. The tamper-indicating band is held in engagement with the container neck by means of a retention element, in most cases a projecting bead, under-cutting, and/or individual ribs. Additional fastening can, for example, be achieved through heat shrinkage. Combinations of differently shaped retaining elements are also known. The tamper-indicating band can be shaped in such a way, for example in the case of disposable beverage bottles, that it is completely separated from the closure cap and remains on the bottle neck. It is also known, for example from U.S. Pat. No. 5,074,425, to provide a tamper-indicating band with fixed connecting bridges through which the tamper-indicating closure is held after the tearable connecting bridges have been ruptured. These types of tamper-indicating bands are therefore mostly provided with one or more vertical tear lines.

When the container is opened for the first time, the tamper-indicating band is at least temporarily retained on the bottle neck so that, during opening of the closure, the connecting bridges tear and indicate the opening procedure.

These types of closures can be manufactured in one piece together with the tamper-indicating band by the plastic injection molding process. The subsequent application of a weakened line to the closure blanks, between the closure cap and the tamper-indicating band, is also known. These types of devices and methods are known from U.S. Pat. No. 3,673,761 (Leitz/CIBA-Geigy AG), German OS-14 82 603 (Teillac/ALCA S.A.) or U.S. Pat. No. 4,895,265 (LUC et al./The West Co.).

With these closures, the weakened line is applied before or after placing the blank on a container, by means of a cutting tool. A blade, a heated cutting edge or a rotating, circular saw type cutting tool can serve as a cutting tool. The weakening of the material can thus be applied to a warmed closure blank or to cold material. The type of cutting tool and the process parameters, as well as the cutting temperature, depend upon the type of plastic used, the size and type of weakened line, the speed of the process, and so on. Laser cutting tools are also able to be employed with such methods.

On the other hand, metal tamper-indicating closures are also known, onto which a tamper-indicating element is subsequently fastened. The tamper-indicating element is here, as a rule, annularly formed with an initial holding section with which it can be brought into interlocking contact with the closure cap. The holding section—and with it the closure cap—is connected with the tamper-indicating band by means of connecting bridges.

Also known are other methods of manufacture of tamper-indicating closures, such as compression molding, co-injection molding and the like.

A difficulty with these types of closures is that the connecting bridges on the one hand must be formed to be sufficiently stable, so as not to be destroyed or damaged, neither during ejection from the tool, nor during storage, handling or placement of the closure onto a container. On the other hand, the badges should tear or break reliably with the slightest possible manipulation, and in any event when opening for the first time or when attempting to open. Therefore a tamper-indicating band is known, for example from U.S. Pat. No. 4,322,009 (Mumford/Owens-Illinois Inc.), the connecting bridges of which are so created with the same thickness and dimensions that the tamper-indicating band and the tamper-indicating closure are separated from one another by a narrow slot and can come into contact with one another when the cap is screwed onto the container.

A tamper-indicating closure is known, U.S. Pat. No. 5,074,425 (Wüstman et al./Crown Cork AG), in which the connecting bridges are weakened on a side which is oriented toward the tearing position.

SUMMARY OF THE INVENTION

The invention has the purpose of improving tamper-indicating closures, in particular the different, previously described types of tamper-indicating closures, in such a way that connecting bridges are created which on the one hand are sensitive and easily able to be damaged in the case of an attempt at manipulation, and on the other hand are sufficiently stable when storing and ejecting from the mold.

According to the invention, this purpose is primarily fulfilled according to the characteristics of the cap described below.

By means of an arrangement of primary and secondary connecting bridges with differing loading capacity, generally a sufficiently firm connection between the tamper-indicating band and the closure cap will be ensured for manufacture, storage and handling. During opening of the container, and with tensile loading of the connecting bridges, the weaker connecting bridges will, however, in practice be immediately destroyed. If the secondary connecting bridges possess a thinner cross section, or at any rate thinner minimal cross section, than the primary connecting bridges, they will permit only a slight expansion of the material before they break. The secondary connecting bridges will be, also in the case of unauthorized manipulation, more easily destroyed than the primary connecting bridges. As soon, however, as the secondary connecting bridges are destroyed, the primary connecting bridges must take up the entire tensile load during opening of the container, so that they will likewise tear as a result. The invention provides a secondary connecting bridge, or preferably, between two and four connecting bridges, arranged in the intermediate space between the primary connecting bridges, the secondary connecting bridges sharing the load with the primary connecting bridges during tensile loading, and after tearing transfer the entire load onto the primary connecting bridges.

Adequate load distribution can also be achieved if in each case alternating intermediate spaces between the primary connecting bridges are provided with secondary connecting bridges, and the remaining spaces are not provided with secondary connecting bridges.

The differing loading capacity of the secondary connecting bridges and primary connecting bridges can be mainly realized through differing material thicknesses and/or through weakened zones in the connecting bridges. For example, the secondary connecting bridges can be weakened by incisions or a reduction in the material, and the primary connecting bridges can be formed with the same thickness as the rest of the material so as to be unweakened. On the other hand, it is also conceivable to provide material weakening not only on the secondary connecting bridges but also on the primary connecting bridges, the secondary connecting bridges being more heavily weakened than the primary connecting bridges.

With regard to the method, the invention can be realized in a particularly simple way if weakened zones can be applied to predeterminable circumferential areas on a closure blank with a cylindrical wall section and a cap base, the differing weakened zones leading to primary connecting bridges and secondary bridges which possess differing material strengths. In this way, for example, connecting bridges can be created by cutting into the material in the cylindrical wall section, the strength of the material of the remaining connecting bridges being able to be varied by the cutting depth.

These types of material weakening can be applied in a particularly simple way by a separating device with a cutting edge, in which differently shaped recesses are provided for forming the primary and secondary connecting bridges. The cutting edge can be heated in a known way.

Naturally, the material weakening can be created also in other ways, for example by means of milling, by heated forceps or with laser cutting devices. It would also, for example, be conceivable to manufacture tamper-indicating closures with identical connecting bridges by means of injection molding or compression molding, and subsequently to weaken individual connecting bridges, in particular to make an incision, in order to create secondary connecting bridges. Alternatively, one could manufacture a closure cap and a tamper-indicating band separately and subsequently join the tamper-indicating band to the closure cap in the area of the connecting bridges, for example by engaging them interlockingly, or by welding the connecting bridges.

BRIEF DESCRIPTION OF THE DRAWINGS

Examples and embodiments of the invention are more closely described below, and illustrated by the drawings, wherein:

FIG. 6*a* is a partial section as in FIG. 3*a* through a further modified embodiment of the invention;

FIG. 6*b* is a side view of the representation according to FIG. 6*a;*

FIGS. 7*a*, 7*b* and 7*c* are representations of a further modification of the connecting bridges;

FIGS. 8 and 9 are schematic representations of arrangements of bridges;

DESCRIPTION OF THE PREFERRED EMBODIMENTS

Figure 1:
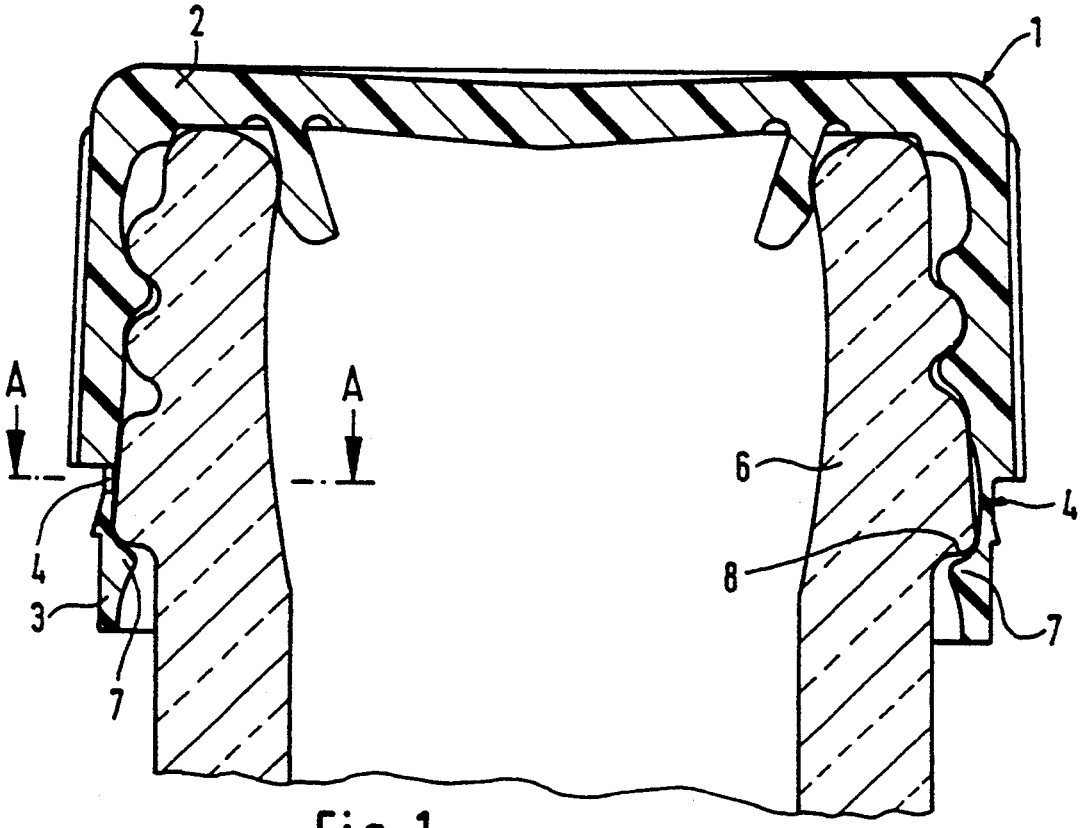
FIG. 1 is a closure cap with the features of the invention in cross section.
Figure 2:
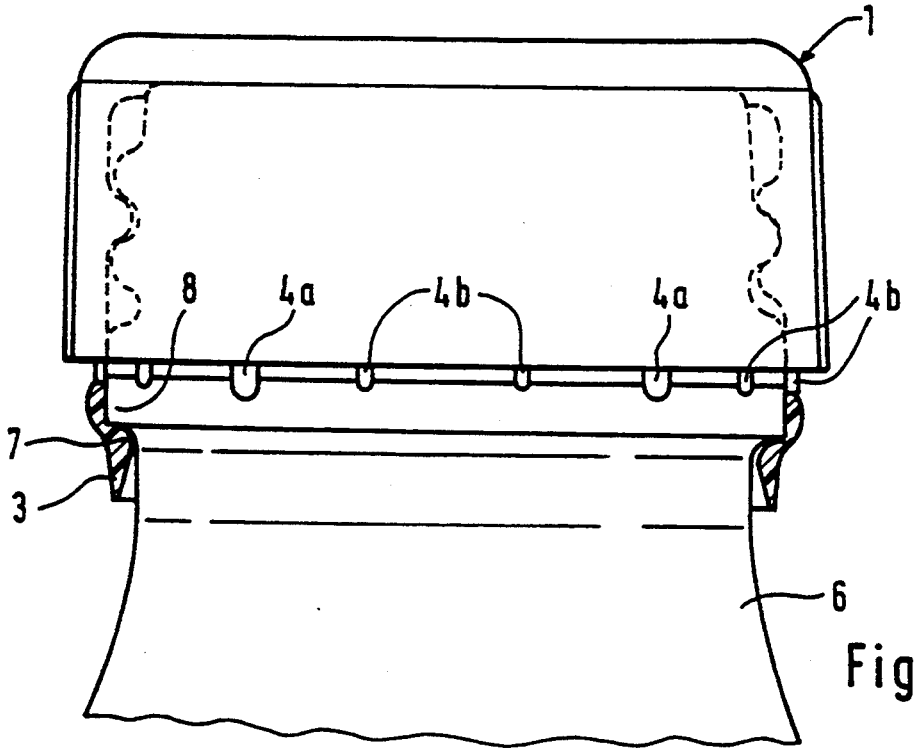
FIG. 2 depicts the closure cap according to FIG. 1, partially in cross section, seen during opening.
Figure 3A:
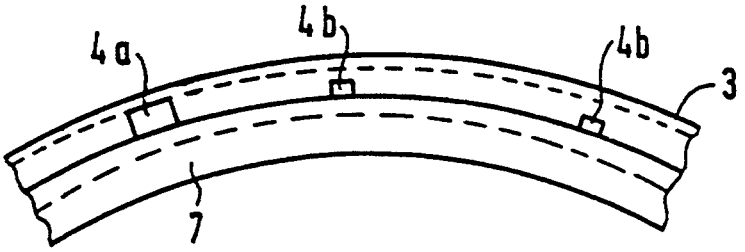
FIG. 3*a* represents a partial cross section along the line A—A in FIG. 1, at an enlarged scale.
Figure 3B:
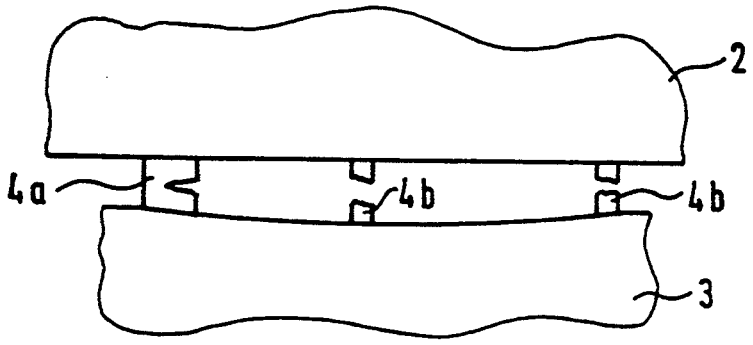
FIG. 3*b* is a side view of the representation shown in FIG. 3*a;*

As shown in FIGS. 1 and 2, a tamper-indicating closure 1, as manufactured by the injection molding process, comprises a closure cap 2 and a tamper-indicating band 3. The tamper-indicating band 3 is connected to the closure cap 2 by connecting bridges 4. The screw cap 2 is screwed onto the neck of a container, a bead 7 of the tamper-indicating band 3 snapping to interlock over a retaining element 8 in the form of a complementary bead on the neck of the container 6. The connecting bridges 4 are formed as primary connecting bridges 4*a*, and as secondary connecting bridges 4*b*. As is evident from FIGS. 2 and 3, the primary connecting bridges 4*a* possess an essentially larger diameter, and thus a larger cross section, than the secondary connecting bridges 4*b*. This has the effect that, during opening of the bottle, first of all the relatively thin and—because of their relatively slender cross section—hardly elastically stretchable secondary connecting bridges 4*b* will tear, through which the force exerted on the primary connecting bridges 4*a* will increase suddenly and the primary connecting bridges 4*a* will likewise start to tear. In the way mainly shown in FIGS. 2 and 3*b*, the tamper-indicating band will first of all start to tear at one position. With continued tearing of the secondary connecting bridges 4*b*, all primary connecting bridges 4*a* will also tear, so that the tamper-indicating closure 1 can be separated from the neck of the container 6.

Figure 4:
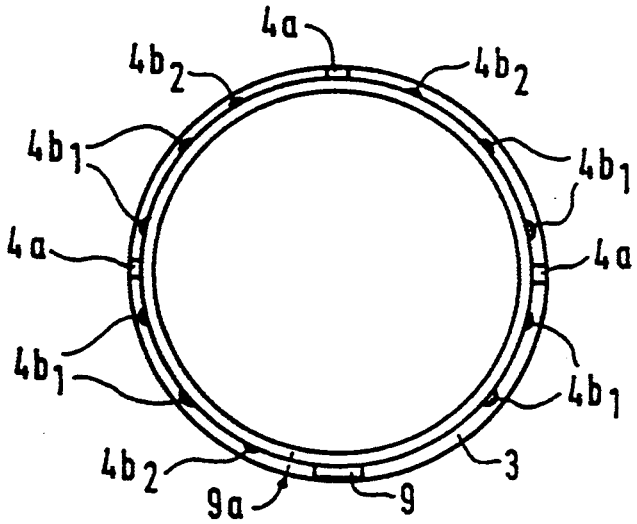
FIGS. 4 and 5 show a modified embodiment of the invention in a cross sectional plane as in FIG. 3*a;*

FIG. 4 shows a modified embodiment, in which primary connecting bridges 4*a* are provided, as well as a first number of secondary connecting bridges $4b_1$, and a second number of secondary connecting bridges $4b_2$. The secondary connecting bridges $4b_1$ are otherwise in accordance with FIGS. 1 to 3*a* and 3*b*, but essentially thinner and thus easier to destroy through tensile loading than the primary connecting bridges 4*a*. The secondary connecting bridges $4b_2$ are formed to be once again thinner than the first secondary connecting bridges $4b_1$. Thus a graduated tearing of the connecting bridges can be achieved, commencing with the connecting bridges $4b_2$, followed by connecting bridges $4b_1$, and finally the primary connecting bridges 4*a*.

In the case of the embodiment according to FIG. 4, an essentially stronger fixing bridge 9 is provided in a known way, which does not tear when the tamper-indicating closure is opened. Additionally, a breakage point 9*a* is provided, at which the tamper-indicating band 3 can tear vertically.

Figure 5:
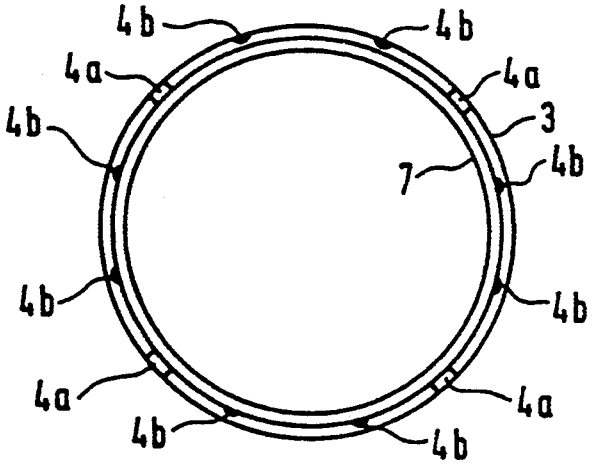

FIG. 5 shows another modified embodiment, with which the secondary connecting bridges 4*b* possess not only a smaller cross section than the primary connecting bridges 4*a*, but are also weakened on one side through an inclination. In this way, tearing of the secondary connecting bridges can be controlled from the direction of their weakened sides.

FIGS. 6*a* and 6*b* show an embodiment with which a primary connecting bridge 4*a* in principle possesses the same cross section as a secondary connecting bridge 4*b*. Both connecting bridges 4*a* and 4*b* are weakened at the tip of their converging surfaces 15, so that lateral tearing will be provoked from this point. As can be seen, however, from the side view according to FIG. 6*b*, the secondary connecting bridge 4*b* is additionally laterally weakened by a notch 10 so that it tears before the primary connecting bridge 4*a*.

FIGS. 7*a* to 7*c* show a similar embodiment, with which primary connecting bridges 4*a* and secondary connecting bridges 4*b* possess approximately the same cross section in their upper areas. While the primary connecting bridge is unweakened, a weakened zone in the form of a notch 10 is provided on the outer side of the secondary connecting bridge 4*b*. FIG. 7*c* schematically shows the section along the line A—A in FIG. 7*a* in an enlarged scale, from which the notch 10 is apparent.

FIG. 8 shows an arrangement of connecting bridges 4*a* and 4*b*, four secondary connecting bridges 4*b* being in each case alternately provided in every other intermediate space between the primary connecting bridges 4*a*. The primary connecting bridges 4*a* are approximately the same thickness as the wall of the tamper-indicating band 3, through which satisfactory manufacturing characteristics will result when employing the injection molding process and also when subsequently cutting the closures. The 4 secondary connecting bridges 4*b* in general give rise to a clear improvement to the connection between the closure cap 2 and the tamper-indicating band 3. Because of its slender cross section, however, it is ensured that the secondary connecting bridges will tear relatively quickly when opening the closure, and thus will transfer the total load onto the primary connecting bridges 4*a*.

FIG. 9 shows an embodiment with which three secondary connecting bridges 4*b* are arranged in each intermediate space between any two primary connecting bridges 4*a* in order to stabilize the tamper-indicating band around its entire circumference.

Figure 10:
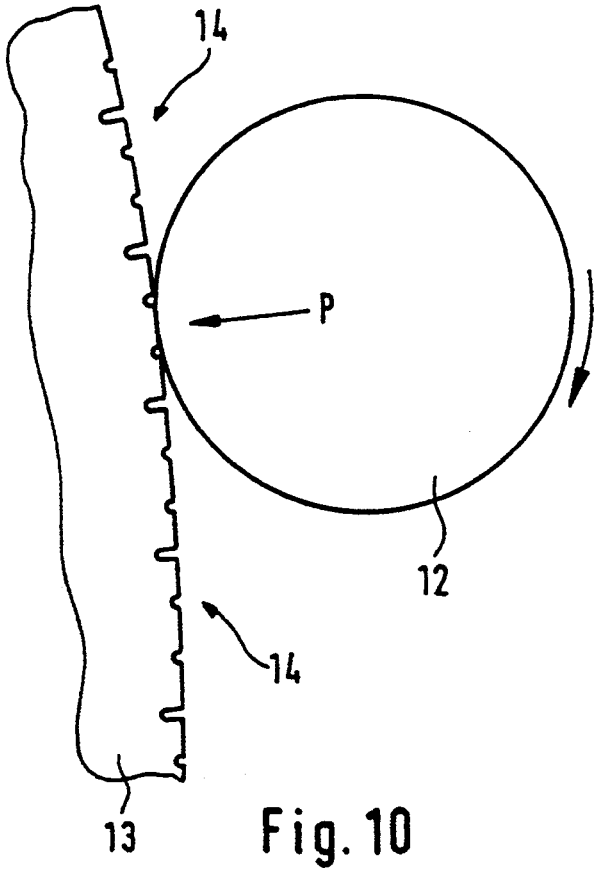
FIG. 10 is a schematic representation of a device for the manufacture of a tamper-indicating closure.
Figure 11:
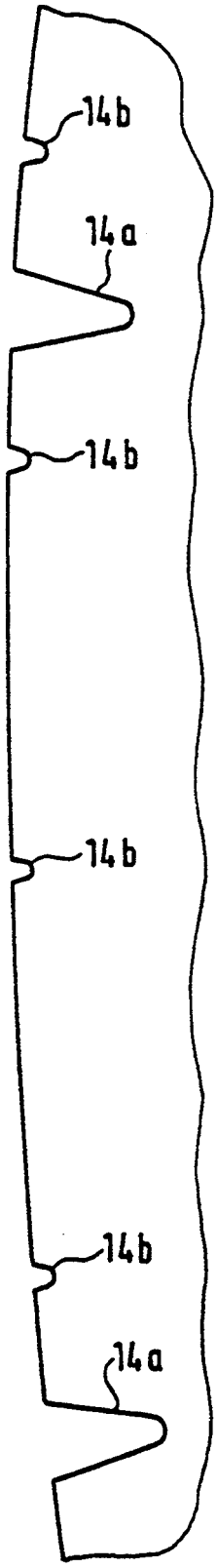
FIG. 11 is a representation of the cutting sequence of the device according to FIG. 10, at an enlarged scale.

FIGS. 10 and 11 show schematically how a closure according to FIG. 9 can be manufactured from a closure blank 12. Here, a cutting blade 13 engages with the closure blank 12 in order to create the connecting bridges with the configuration according to FIG. 9. The blank 12 is rolled up on the heated cutting blade 13, by a device not shown here, in such a way that the cutting blade 13 cuts through the wall of the blank 12. Only in the area of the recesses 14 does the cutting blade 13 not completely penetrate the wall of the blank 12, so that the bridges 4*a* and 4*b* remain.

FIG. 11 shows, greatly enlarged, the facing edge of the cutting blade 13. It can be seen that larger recesses 14*a* for the creation of the primary connecting bridges, as well as smaller recesses 14*b* for creation of the secondary connecting bridges, are provided on the cutting blade 13.

Naturally, through appropriate shaping, the recesses 14, 14*a* and 14*b* permit the formation of practically any desired bridge shape and graduated cross sectional shapes. Thus, for example, more than two differing weaker secondary connecting bridges or different cross sectional shapes of individual connecting bridges can be created.

Inasmuch as the invention is subject to modifications and variations, the foregoing description and accompanying drawings should not be regarded as limiting the invention, which is defined by the following claims and various combinations thereof.

What is claimed is:

1. A tamper-indicating closure of the type that is constructed and arranged to be fitted over an externally threaded container neck that has a retaining element thereon, comprising:

a closure cap that is shaped to fit over the container neck;

a tamper-indicating band that is constructed and arranged to engage the retaining element of the container neck;

at least three relatively strong connecting bridges connecting said closure cap to said tamper-indicating band, said strong connecting bridges being constructed to break when said closure cap is removed from the container neck, said at least three relatively strong connecting bridges defining at least two gaps therebetween; and at least two relatively weak connecting bridges, positioned in each of said gaps, connecting said closure cap to said tamper-indicating band, said weak connecting bridges also being constructed to break when said closure cap is removed from the container neck, said weak and strong connecting bridges being designed so that said weak bridges break before said strong bridges when said closure cap is unscrewed from the container neck, whereby the relative positions of the weak and strong bridges will ensure an even, predictable opening sequence about the periphery of the closure and the container neck,

2. A tamper-indicating closure of the type that is constructed and arranged to be fitted over an externally threaded container neck that has a retaining element thereon, comprising:

a closure cap that is shaped to fit over the container neck;

a tamper-indicating band that is constructed and arranged to engage the retaining element of the container neck;

more than one relatively strong connecting bridge connecting said closure cap to said tamper-indicating band, said strong connecting bridges being constructed to break when said closure cap is removed from the container neck; and more than one relatively weak connecting bridge, said weak connecting bridges also being constructed to break when said closure cap is removed from the container neck, said weak and strong connecting bridges both being spaced substantially evenly about the periphery of said closure so that said weak bridges break before said strong bridges when said closure cap is unscrewed from the container neck, whereby the relative positions of the weak and strong bridges will ensure an even, predictable opening sequence about the periphery of the closure and the container neck.

* * * * *